US006908341B2

(12) United States Patent
Shirae et al.

(10) Patent No.: US 6,908,341 B2
(45) Date of Patent: Jun. 21, 2005

(54) BATTERY CONNECTOR

(75) Inventors: Yutaka Shirae, Kyoto (JP); Kazuo Yoneyama, Kyoto (JP); Hideki Nishiyama, Yao (JP); Hiroshi Uchida, Yao (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 10/720,227

(22) Filed: Nov. 25, 2003

(65) Prior Publication Data

US 2004/0115998 A1 Jun. 17, 2004

(30) Foreign Application Priority Data

Dec. 13, 2002 (JP) ..... 2002-362258

(51) Int. Cl.[7] ..... H01R 24/00
(52) U.S. Cl. ..... 439/626
(58) Field of Search ..... 439/626, 627

(56) References Cited

U.S. PATENT DOCUMENTS 5,891,591 A * 4/1999 Suzuki ..... 429/178

FOREIGN PATENT DOCUMENTS

JP 2001-502837 2/2001

* cited by examiner

*Primary Examiner*—Javaid H. Nasri
(74) *Attorney, Agent, or Firm*—Bacon & Thomas

(57) ABSTRACT

A battery connector in which, even when an engagement piece portion that is required for applying a preload to a contact of a contact member rubs with an engagement face formed in a wall face of a housing made of a synthetic resin, possibilities that the engagement face is shaved, and that the engagement piece portion is deformed can be eliminated. In the battery connector, a meandering contact member is housed in a housing. A mountain-like projection of the contact member is projected from an opening of the housing. An engagement piece portion formed in the mountain-like projection is engaged with an engagement face of the housing to apply a preload to the contact. The engagement piece portion has a shape which is free from an angular edge. Specifically, the engagement piece portion has a planar portion, and projection pieces which are continuously integrated with the planar portion through arcuate bent portions. Swollen portions having an arcuate face may be formed on the planar portion.

11 Claims, 11 Drawing Sheets

BATTERY CONNECTOR

BACKGROUND OF THE INVENTION

1. Field of the Invention

The present invention relates to a battery connector which is useful for, for example, charging a battery, and more particularly to a battery connector in which an engagement piece disposed on a contact member is engaged under a preload with an engagement face of a housing.

2. Description of the Prior Art

A conventional battery connector of this kind is disclosed in PCT National Patent Publication No. 2001-502837. The disclosed connecter will be described with reference to FIG. 9 or 10.

FIG. 9 is a section view of the conventional battery connector, and FIG. 10 is a perspective view of a contact member which is used in the conventional battery connector.

In the battery connector, as shown in FIG. 9, a meandering contact member 210 is housed in a housing 200 in which the lower end is placed on a board face of a circuit board 100. As shown in FIG. 10, the contact member 210 is formed into a meandering shape in which three slender plate piece portions are continuously integrated with one another through two flexible portions 216, 217 that are arcuately protruded. As shown in FIG. 9, a mountain-like projection 212 which is formed in the plate piece portion of one end side of the contact member 210 is projected through an oblong opening 205 that is formed in the upper wall of the housing 200, and its top is formed as a contact 213 which is to be in elastic contact with a battery terminal (not shown). A fix piece 214 which is fixed to a wall 201 of the housing 200, and a soldering terminal 215 which is foldedly formed to be connected to a pattern on the circuit board 100 are formed in the plate piece portion of the other end side of the contact member 210. The lower flexible portion 216 is fitted into a hole 203 which is formed in another wall 202 of the housing 200, and the upper flexible portion 217 is opposed to the wall 201.

An end portion of the mountain-like projection 212 of the contact member 210 is bent in a substantially perpendicular manner toward the inner side (in the illustrated example, the lower side) of the mountain-like projection 212. The folded end portion is provided with a rectangular engagement piece portion 220 which is laterally projected. An end face of the engagement piece portion 220 is in elastic contact under a preload with an engagement face 206 which is formed by a wall face of a peripheral portion of the opening 205, to be engaged therewith. The degree of projection of the mountain-like projection 212 from the opening 205 of the housing 200 is restricted by the configuration where the engagement piece portion 220 is in elastic contact and engaged with the engagement face 206 under a preload as described above.

In the battery connector, in an initial state where no external force acts on the contact member 210, the engagement piece portion 220 is overlappingly in elastic contact with the engagement face 206 of the housing 200 as shown in FIG. 9. When a battery D is to be charged, the battery D is attached to and detached from the connector.

In the operation of attaching the battery D, the battery D is inserted into the connector in the direction of the arrow C1 of FIG. 9 which is perpendicular to the compression direction (vertical direction) of the meandering contact member 210. As a result, the battery D is caused to slide over the mountain-like projection 212 to retract the mountain-like projection 212, so that a terminal of the battery D is pressed against the contact 213 of the projection to be in elastic contact therewith. At this time, the contact member 210 is compressed, the mountain-like projection 212 is retracted as indicated by the arrow c1 to be pressed into the opening 205, and the engagement piece portion 220 separates from the engagement face 206. As a result of the retraction of the mountain-like projection 212, a situation in which an arcuate portion 221 of the one end of the contact member 210 strikes against the wall 202, or the flexible portion 217 strikes against and rubs with the wall 201 sometimes occur. By contrast, in the operation of detaching the battery D, the battery D is separated from the connector in the direction of the arrow C2 of FIG. 9 which is perpendicular to the expansion direction of the meandering contact member 210. At this time, the contact member 210 which has been compressed by the flexural deformation is expanded, and the mountain-like projection 212 is displaced as indicated by the arrow c2, whereby the mountain-like projection 212 is projected from the opening 205. As a result, the engagement piece portion 220 is engaged with the engagement face 206, and the connector is returned to the initial state to be prepared for the next use.

As shown in FIG. 11 illustratively showing problems of the conventional example, in the conventional example, a situation possibly occurs where the operations of attaching and detaching the battery causes the end face of the engagement piece portion 220 to rub with the engagement face 206 in the direction of the arrow d1 or d2 while maintaining the elastic contact with the engagement face. When such a situation occurs, there is the possibility that the engagement piece portion 220 which is a metal portion shaves the engagement face 206 which is a synthetic resin portion, or that the thin engagement piece portion 220 is caught by the engagement face 206 to be deformed.

When the engagement piece portion 220 shaves the engagement face 206 or the engagement piece portion 220 is deformed, the housing 200 is reduced in strength to be easily cracked or deformed, or the deformation of the engagement piece portion 220 causes the engagement piece portion 220 not to be engaged with the engagement face 206, so that the engagement piece portion 220 is projected from the opening 205. As a result, the performance required in a battery connector cannot be exerted.

SUMMARY OF THE INVENTION

The invention has been conducted under the above-discussed circumstances. It is an object of the invention to provide a battery connector in which the shape or the structure of an engagement piece portion is improved, and, even when the engagement piece portion rubs with an engagement face of a housing, there is no possibility that the engagement face is shaved, or that the engagement piece portion is deformed.

It is another object of the invention to provide a battery connector in which, even when the engagement piece portion of the battery connector which has been described in the conventional example rubs with an engagement face of a housing, possibilities that the engagement face is shaved, and that the engagement piece portion is deformed can be eliminated only by applying a very simple change on the shape or the structure of the engagement piece portion.

It is a further object of the invention to provide a battery connector which can attain the objects, and in which the height in the case where the connector is mounted on a circuit board can be easily reduced.

It is a still further object of the invention to provide a battery connector which can attain the objects, and in which the height of a housing can be easily reduced and the strength can be easily enhanced.

The battery connector of the invention has:

a meandering contact member in which a plurality of plate piece portions are continuously integrated with one another through one or more arcuate flexible portions;

a mountain-like projection which is formed in one of the plate piece portions that is on one end side of the contact member, and in which a top is formed as a contact that is to be in elastic contact with a battery terminal;

a housing which houses the contact member;

an opening which is formed in the housing, and through which the mountain-like projection is projected;

an arcuate portion which is formed in the mountain-like projection to be bent toward an inner side of the mountain-like projection, and an engagement piece portion which is laterally projected from an end portion of the arcuate portion; and an engagement face which is formed by a rear face of a peripheral portion of the opening, and with which the engagement piece portion is in elastic contact and engaged under a preload, whereby a degree of projection of the mountain-like projection from the opening is restricted.

The battery connector further has a wall face of the housing that is to confront a board face of a circuit board on which the housing is to be mounted, and that opposes the arcuate portion of the mountain-like projection, and the engagement piece portion is displaced in a direction along which the board face of the circuit board and the wall face of the housing confront each other, to be in sliding contact with the engagement face, and has a shape which is free from an angular edge that, when the engagement piece portion is in sliding contact with the engagement face, shaves the engagement face.

According to the configuration, even when the mountain-like projection is displaced in a direction along which the board confronts the circuit board and the wall face of the housing face each other, a situation where the engagement piece portion shaves the engagement face, or where the engagement piece portion is caught by the engagement face to be deformed does not occur because the engagement piece portion has the shape which is free from an angular edge that shaves the engagement face. Since the configuration in which the engagement piece portion has the shape which is free from an angular edge is employed, a battery connector in which, even when the engagement piece portion rubs with the engagement face of the housing, there is no possibility that the engagement face is shaved, or that the engagement piece portion is deformed can be provided only by applying a very simple change on the shape or the structure of the engagement piece portion of the battery connector which has been described in the paragraph of the prior art.

In the invention, the configuration may be employed where the engagement piece portion integrally has: a planar portion in which an edge of each of lateral sides is elongated in the confronting direction, and which is slidably contactable with the engagement face; and a projection piece which, in each of sides of a vertical width direction of the planar portion, is elongated through an arcuate bent portion in a direction away from the engagement face.

The configuration may be employed where the engagement piece portion integrally has: a planar portion; and a swollen portion which is formed on the planar portion, and which comprises an arcuate face that is to butt against the engagement face to hold the planar portion to a position separated from the engagement face.

Preferably, the housing is configured so that a portion that is opposed to a wall face of the housing to which the arcuate portion of the mountain-like projection is opposed is formed as an aperture, and the aperture is closed by the circuit board on which the housing is to be placed. When this configuration is employed, no wall exists in the portion where the aperture is formed, and hence the height of the housing can be correspondingly reduced.

Preferably, the housing has: a surrounding wall having the opening; a supporting wall which is opposed to the surrounding wall; and a covering wall which extends between upper ends of the surrounding wall and the supporting wall one of the plate piece portions that is on another end side of the contact member is placed to overlap with the supporting wall, and one of the flexural portions which is continuously integrated with the plate piece portion of the other end side is fitted into a recess formed in the covering wall. When this configuration is employed, the configuration acts synergistically with the structure in which the aperture is formed in the housing, to further enhance the reduction of the height of the housing.

Preferably, a lower half of the surrounding wall is forward projected, and a reinforcing wall which closes a lower portion of the opening is formed integrally on the projected portion. Preferably, the reinforcing wall is disposed in each of right and left or two places of the projected portion, and a reinforcement terminal which reinforces the housing is placed in a recess between the reinforcing walls. When this configuration is employed, the housing is reinforced by the reinforcing walls and the reinforcement terminal, and hence the strength of the housing is correspondingly enhanced.

As described above, in the battery connector of the invention, even when the engagement piece portion rubs with the engagement face of the housing, the possibilities that the engagement face is shaved, and that the engagement piece portion is deformed are eliminated. Therefore, it is possible to provide a battery connector in which situations where, as a result of use, the housing is early cracked or deformed because of insufficient strength, or where the contact member is deformed do not occur, and the initial performance can be exerted for a long term. The height in the case where the connector is mounted on a circuit board can be easily reduced. Therefore, the battery connector and hence an apparatus in which the battery connector is mounted can be readily miniaturized.

DETAILED DESCRIPTION OF THE PREFERRED EMBODIMENT

Figure 1:
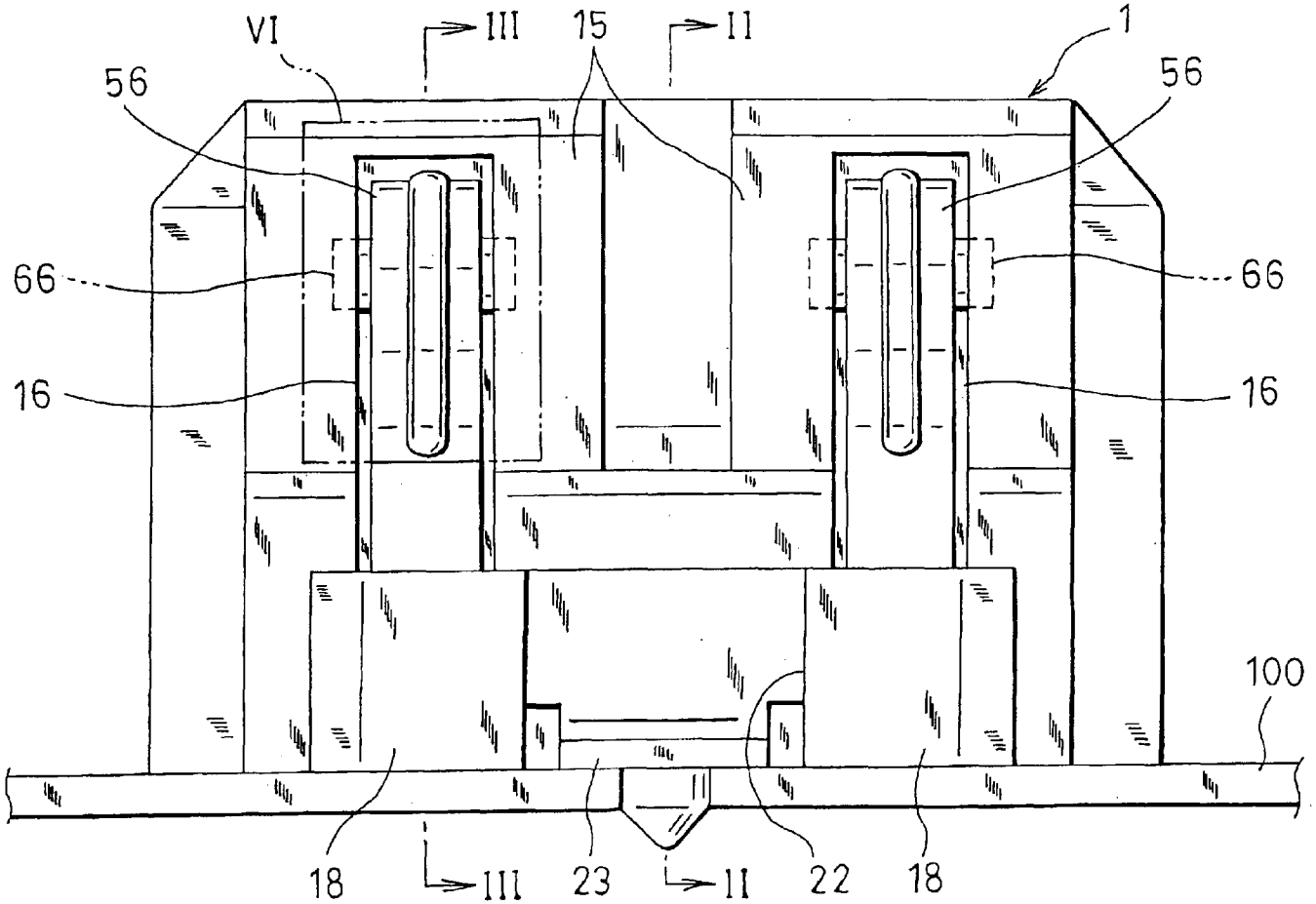
FIG. 1 is a front view of a battery connector according to the invention.
Figure 2:
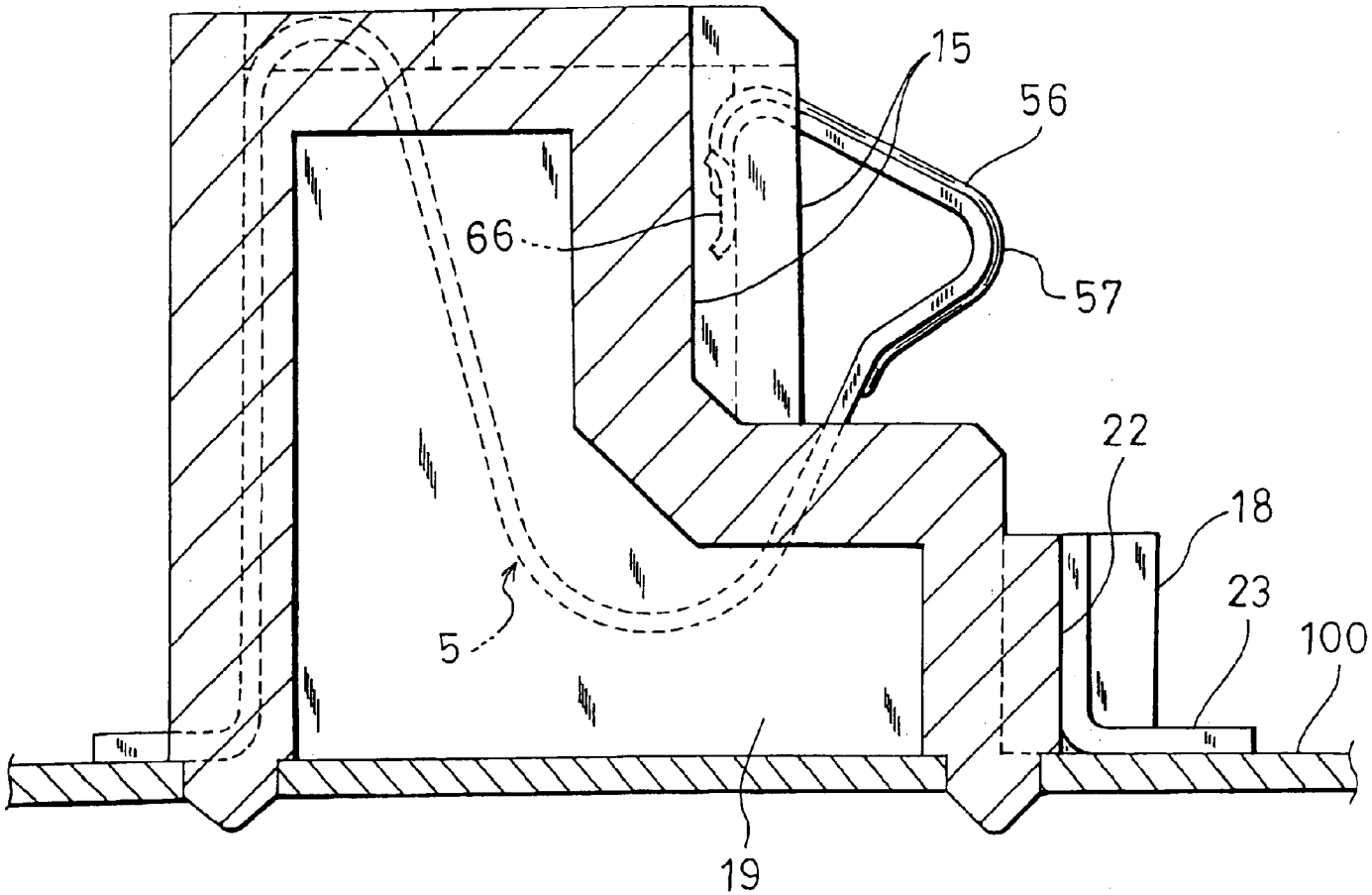
FIG. 2 is a section view taken along line II—II of FIG. 1.

As shown in FIG. 1 or 2, the battery connector comprises a housing 1 formed by a molded product of a synthetic resin, and a contact member 5 formed by a metal piece which is housed in an internal space of the housing 1.

Figure 3:
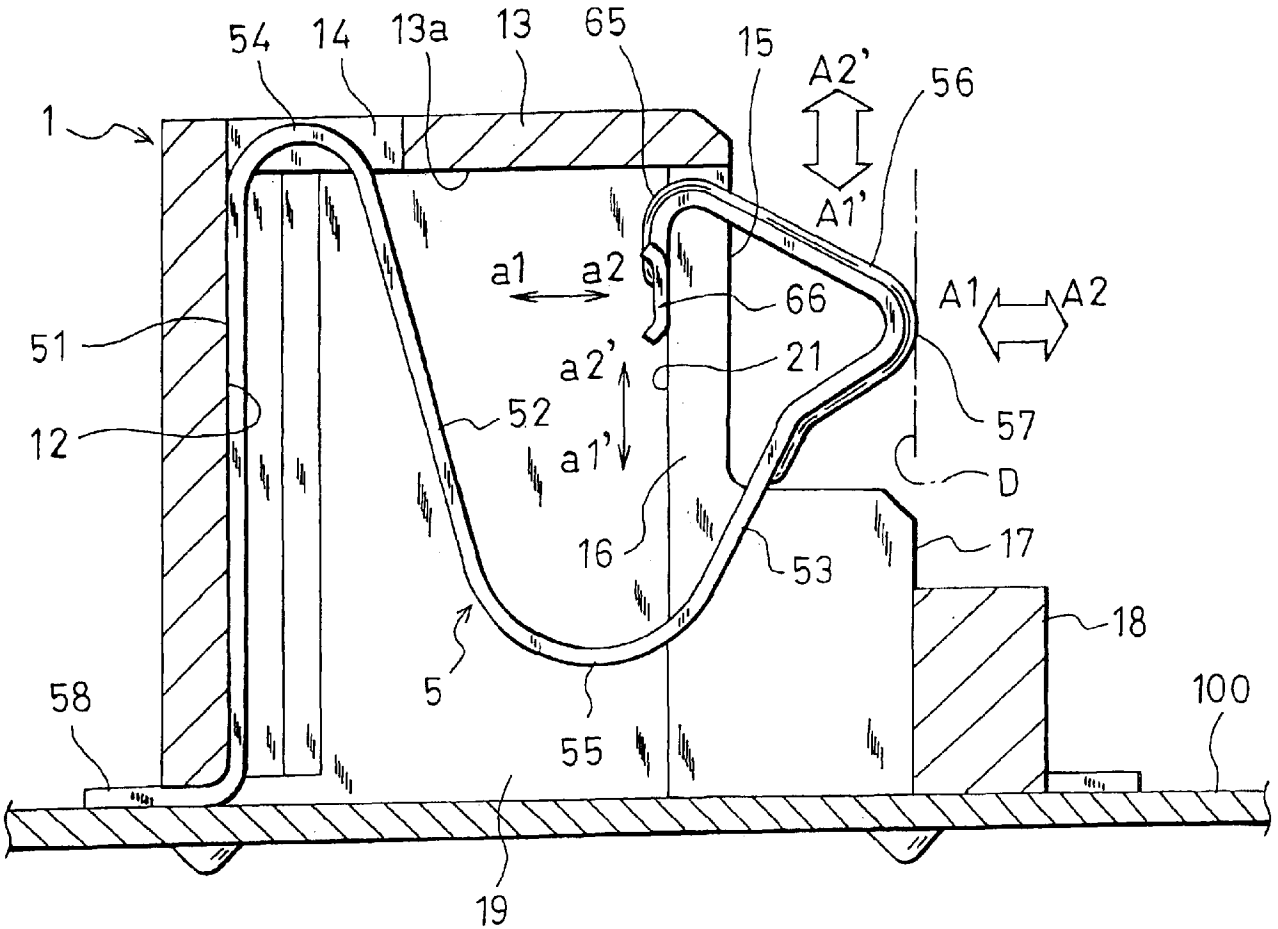
FIG. 3 is a section view taken along line III—III of FIG. 1.

As shown in FIG. 2 or 3, the contact member 5 is configured by continuously integrating three slender plate piece portions 51, 52, 53 in a meandering manner with one another through flexible portions 54, 55 that are arcuately protruded. A mountain-like projection 56 is formed in the plate piece portion 53 of one end side of the contact member 5, and the top of the mountain-like projection 56 is formed as a contact 57 which is to be in elastic contact with a battery terminal (not shown). The plate piece portion 51 of the other end side of the contact member 5 is placed so as to overlap with a supporting wall face 12 of the housing 1, and the flexible portion 54 which is continuously integrated with the plate piece portion 51 is fitted into a recess (in the illustrated example, a hole) formed in a covering wall 13 of the housing 1. An end portion of the plate piece portion 51 is perpendicularly bent to be formed as a terminal 58 which is projected to the rear side of the housing 1. By contrast, the housing 1 has an oblong opening 16 formed in a surrounding wall 15. A lower half of the surrounding wall 15 is forward projected, and reinforcing walls 18 which close a lower portion of the opening 16 are formed integrally on the projected portion 17. In the housing 1, a portion that is opposed to the covering wall 13 is formed as an aperture 19. In the state where the housing 1 is placed on a board face of a circuit board 100 as shown in the figure, the aperture 19 is closed by the circuit board 100.

Figure 6:
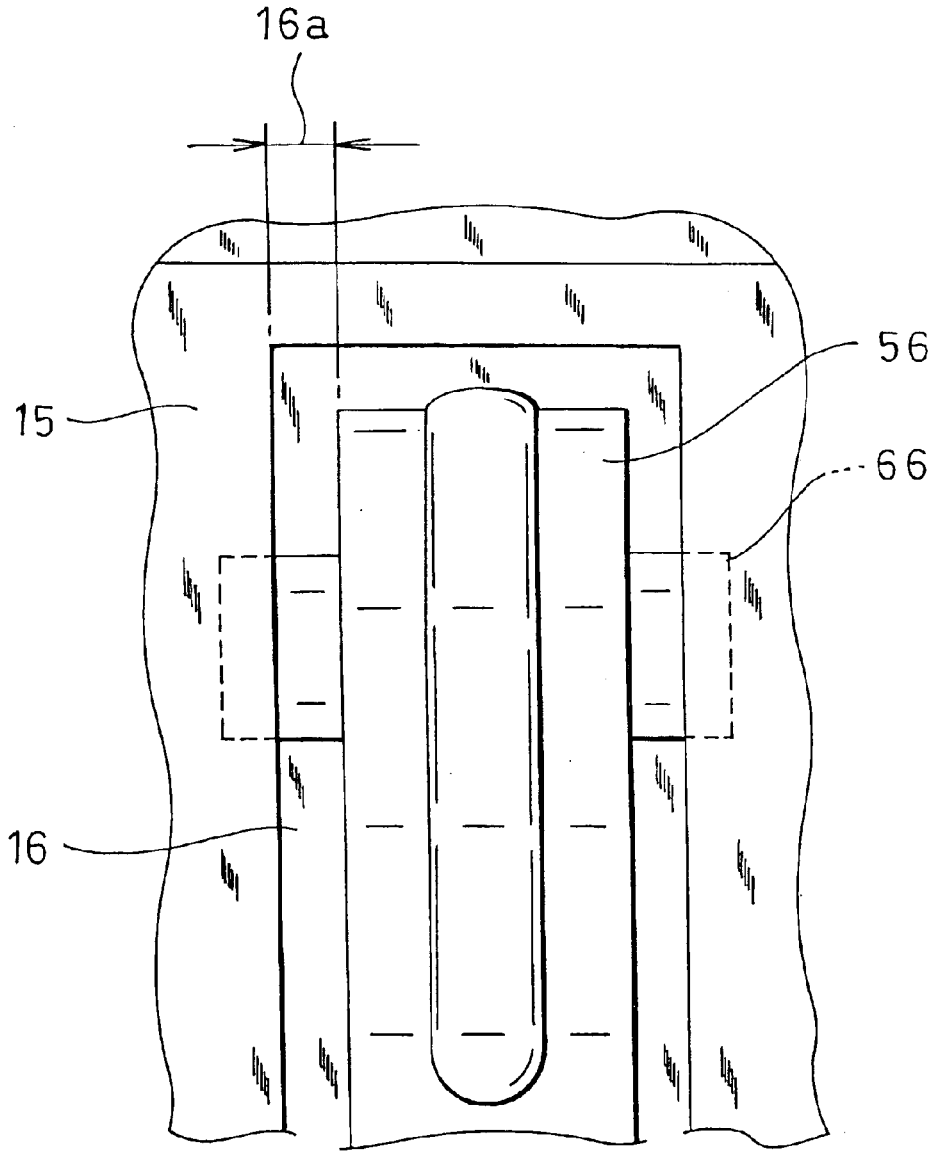
FIG. 6 is an enlarged view of portion VI of FIG. 1.

As shown in FIG. 3, the mountain-like projection 56 of the contact member 5 comprises: an arcuate portion 65 which is bent toward the inner side (in the illustrated example, the lower side) of the mountain-like projection 56, to be opposed to a wall face 13*a* of the covering wall 13 of the housing 1; and an engagement piece portion 66 which is laterally stretched from an end portion of the arcuate portion 65. The engagement piece portion 66 is in elastic contact and engaged under a preload with a rear face of a peripheral portion of the opening 16 of the housing 1, i.e., an engagement face 21 which is formed by a rear face of the surrounding wall 15. Since the engagement piece portion 66 is in elastic contact and engaged under a preload with the engagement face 21, the degree of projection of the mountain-like projection 56 from the opening 16 of the housing 1 is restricted. As shown in FIG. 6, predetermined interspaces 16*a* are ensured between right and left peripheral portions of the opening 16 and the mountain-like projection 56. The interspaces 16*a* prevent the mountain-like projection 56 from being in contact with the periphery when the projection is advanced or retracted. When the mountain-like projection 56 is displaced, therefore, a situation where the mountain-like projection 56 rubs with the periphery to shave it, or where the mountain-like projection 56 is deformed hardly occurs.

Figure 4:
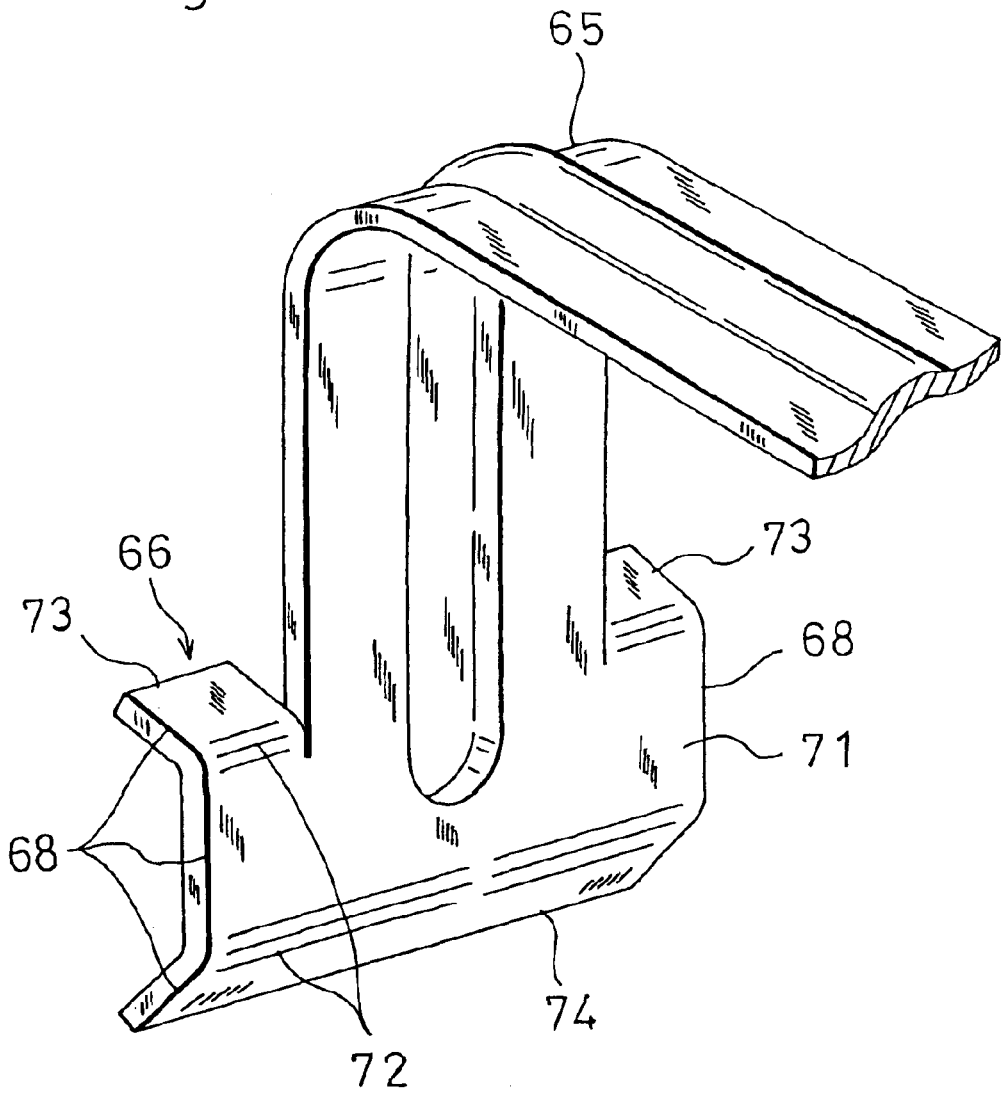
FIG. 4 is a partial perspective view showing the shape of an engagement piece portion.

As shown in FIG. 4, the engagement piece portion 66 of the contact member 5 is formed into a shape which is stretched in both the lateral sides from the end portion of the arcuate portion 65 formed in the mountain-like projection 56. The engagement piece portion 66 integrally has: a rectangular planar portion 71 which is laterally elongated; and a pair of projection pieces 73, 74 which are on the sides of the vertical width direction of the planar portion 71, respectively, and which are elongated through arcuate bent portions 72. In the illustrated example, the upper projection piece 73 is formed into a shape in which the piece is divided into sub-pieces that are on the sides of the end portion of the arcuate portion 65, respectively. An edge 68 of each lateral side of the engagement piece portion 66 is elongated in the longitudinal direction of the opening 16 of the housing 1, i.e., the direction (vertical direction) along which, when the housing 1 is placed on the board face of the circuit board 100 as shown in FIG. 3, the inner wall face 13*a* of the covering wall 13 confronts the circuit board 100. Even when the engagement piece portion 66 is displaced in the vertical direction indicated by the arrow a1' or a2' of FIG. 3 while maintaining the elastic contact with the engagement face 21, therefore, the edges 68 of the lateral sides of the engagement piece portion 66 do not shave the engagement face 21.

Figure 5:
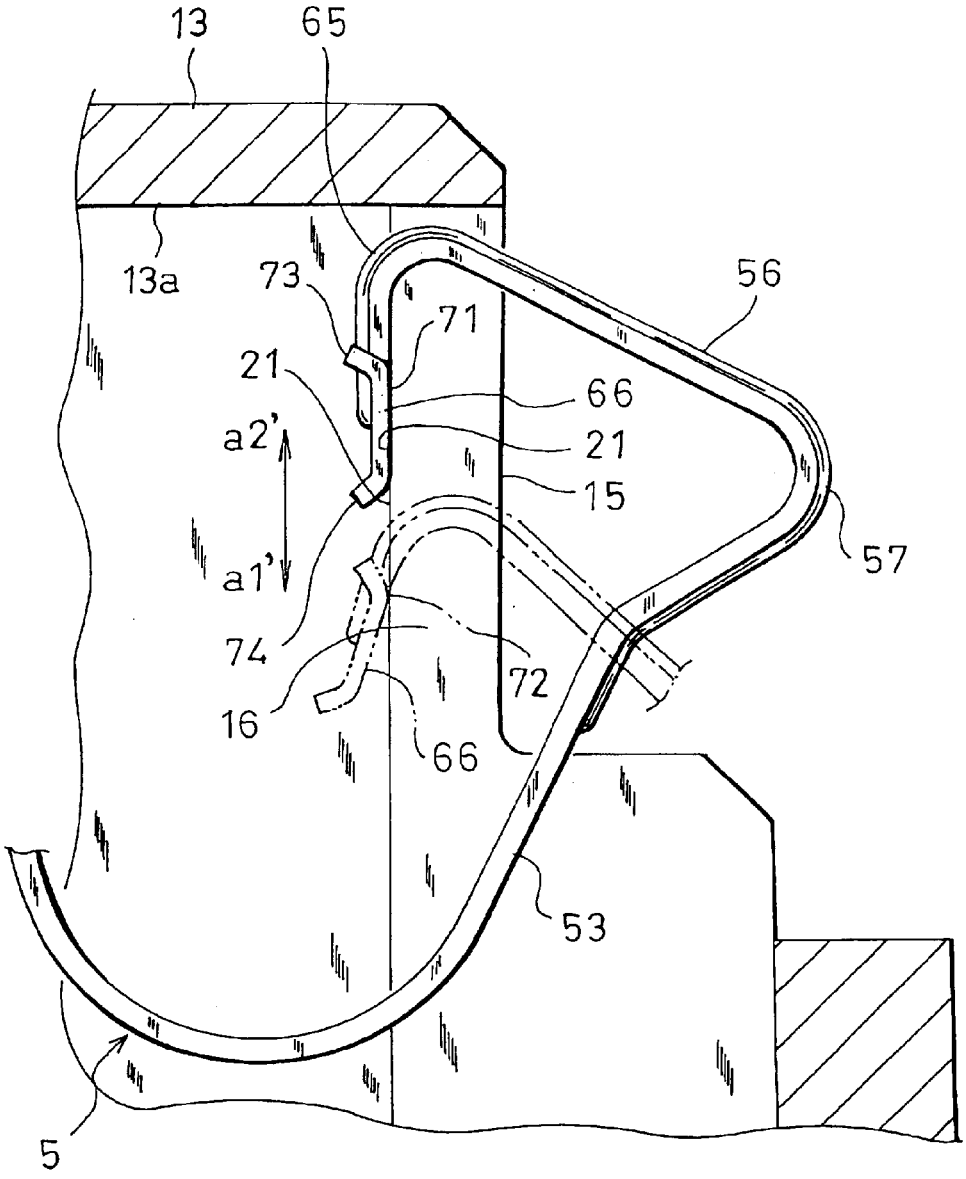
FIG. 5 is a view illustrating the function enlargedly showing main portions of FIG. 3.

In an initial state where no external force acts on the contact member 5, as shown in FIG. 5, the planar portion 71 of the engagement piece portion 66 is overlappingly in surface contact with the engagement face 21 of the housing 1 in an elastically pressed state, and the upper and lower projection pieces 73, 74 are elongated in a direction away from the engagement face 21. Furthermore, the arcuate portion 65 of the mountain-like projection 56 confronts the wall face 13*a* of the covering wall 13 of the housing 1 via a small gap. In the embodiment, a reinforcement terminal 23 is placed in a recess 22 between the right and left reinforcing walls of the housing 1 to reinforce the housing 1 (see FIG. 1 or FIG. 2).

In the battery connector, in a process of, for example, charging a battery D, the operations of attaching and detaching the battery D are performed.

In the operation of attaching the battery, the battery D is inserted into the connector in the direction of the arrow A1 of FIG. 3 which is parallel to the compression direction of the meandering contact member 5, whereby a terminal of the battery is pressed against the contact 57 of the mountain-like projection 56 to be in elastic contact therewith. At this time, the contact member 5 is compressed mainly by means of the flexural deformation of the flexible portions 54, 55, the mountain-like projection 56 is retracted as indicated by the arrow a1 to be pressed into the opening 16, and the engagement piece portion 66 separates from the engagement face 21. As a result of the retraction of the mountain-like projection 56, a situation in which the arcuate portion 65 strikes against and rubs with the wall face 13*a* of the covering wall 13 sometimes occurs. By contrast, in the operation of detaching the battery D, the battery D is separated from the connector in the direction of the arrow A2 of FIG. 3 which is parallel to the expansion direction of the meandering contact member 5. At this time, the contact member 5 which has been compressed by the flexural deformation is expanded, and the mountain-like projection 56 is forward displaced as indicated by the arrow a2, so as to be projected from the opening 16. As a result, the engagement piece portion 66 is engaged with the engagement face 21, and the connector is returned to the initial state to be prepared for the next use. In the usual battery attaching operation, therefore, a situation where the engagement piece portion 66 rubs with the engagement face 21 seldom occurs. In some cases, however, when the mountain-like projection 56 is displaced forward or rearward, a situation may possibly occur where the engagement piece portion 66 rubs with the engagement face 21 in only a short length range.

The case will be considered where an external force in the direction indicated by the arrow A1' or A2' of FIG. 3 is applied to the mountain-like projection 56 for any reason and the engagement piece portion 66 slides in the direction indicated by the arrow a1' or a2' while maintaining the elastic contact with the engagement face 21. In this case, a situation may possibly occur in which the planar portion 71 of the engagement piece portion 66 which has been described with reference to FIG. 4 overlaps and rubs with the engagement face 21 in a surface contact state, or in which the engagement piece portion 66 is inclined to rub with the engagement face 21 as indicated by the phantom line in FIG. 5. In the situation in which the planar portion 71 overlaps and rubs with the engagement face 21, since the planar portion 71 has no angular edge that may shave the engagement face 21, the engagement face 21 is not shaved, and the engagement piece portion 66 is not caught by the engagement face 21 to be deformed. Also when the situation in which the engagement piece portion 66 is inclined to rub with the engagement face 21 occurs, the arcuate bent portions 72 of the engagement piece portion 66 rubs with the engagement face 21 as indicated by the phantom line in FIG. 5. In this case also, therefore, the engagement face 21 is not shaved, and the engagement piece portion. 66 is not caught by the engagement face 21 to be deformed.

As a result of advancing or retracting displacement of the mountain-like projection 56, the arcuate portion 65 may sometimes strike against and rub with the wall face 13*a* of the covering wall 13. In this case, since no angular edge which may shave the wall face 13*a* exists in the arcuate portion 65, the wall face 13*a* is not shaved, and the mountain-like projection 56 is not deformed.

In the embodiment, the housing 1 is configured so that the portion opposed to the covering wall 13 is formed as the aperture 19 or a wall in the portion is omitted, and, when the housing 1 is placed on the board face of the circuit board 100, the aperture 19 is closed by the circuit board 100. Furthermore, the flexible portion 54 of the contact member 5 is fitted into the recess 14 of the covering wall 13. Therefore, reduction of the height of the housing 1 is realized. The strength of the surrounding wall 15 having the opening 16 is improved by the reinforcing walls 18 formed on the projected portion 17 in the lower half of the surrounding wall 15 in which the opening 16 is formed. Consequently, the connector has an advantage that the whole is small in size and excellent in strength.

Figure 7A:
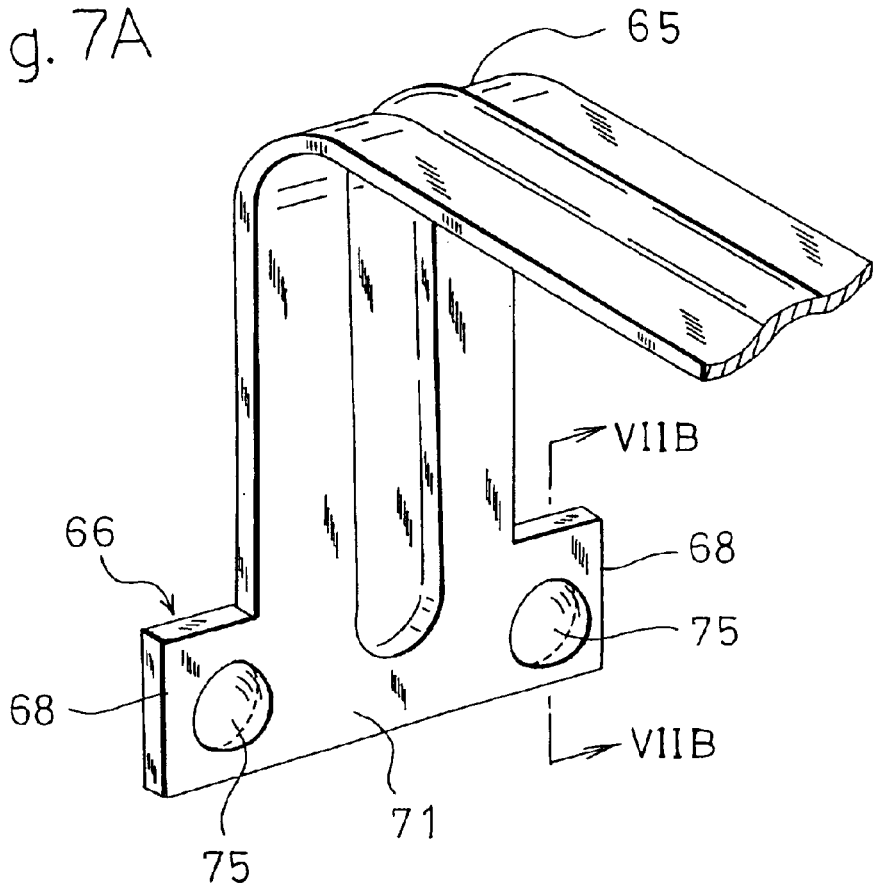
FIG. 7A is a perspective view showing a modification of the engagement piece portion.
Figure 7B:
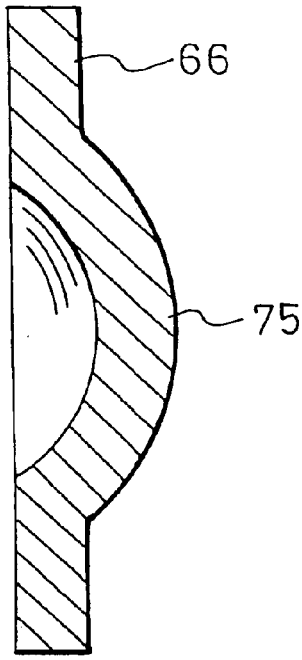
FIG. 7B is an enlarged section view taken along line VIIB—VIIB of FIG. 7A.
Figure 8:
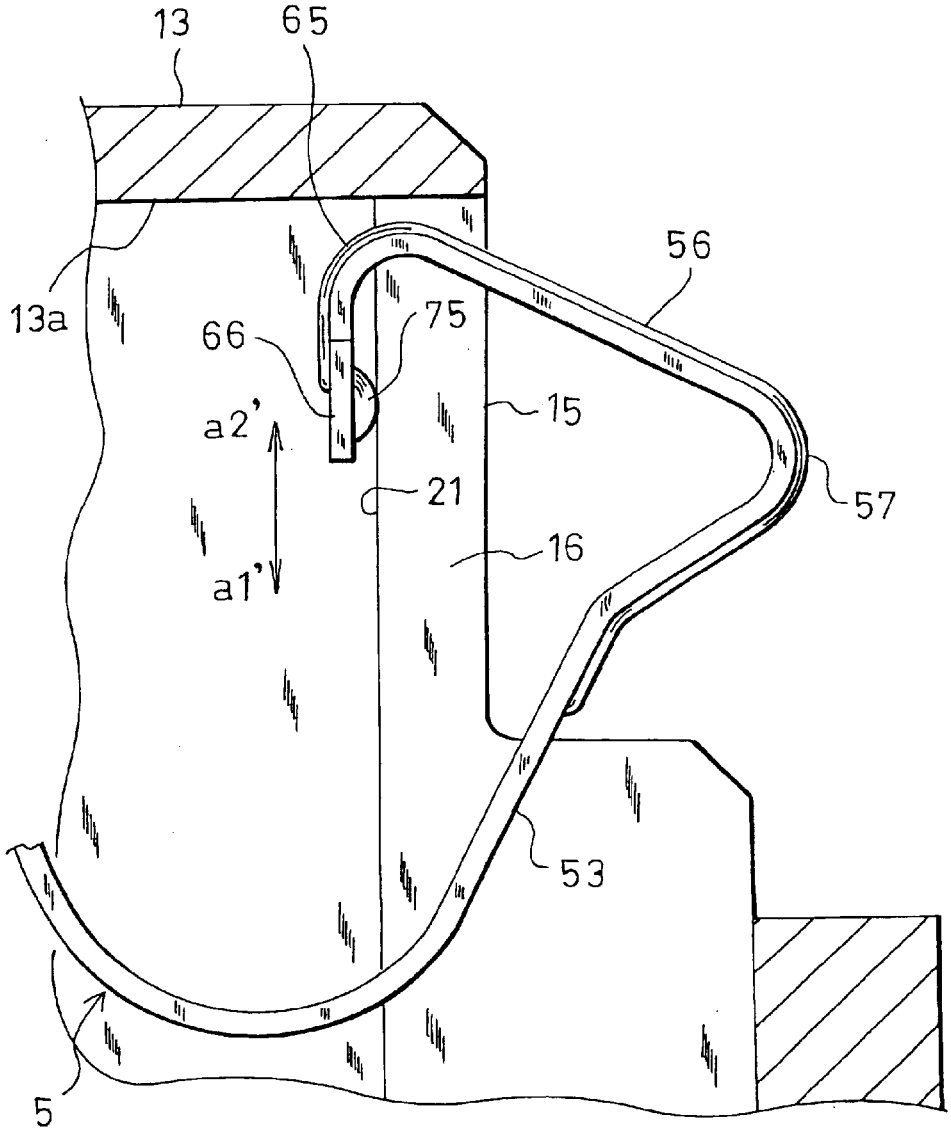
FIG. 8 is a view illustrating the function which is exerted by the engagement piece portion of FIGS. 7A and 7B.
Figure 9:
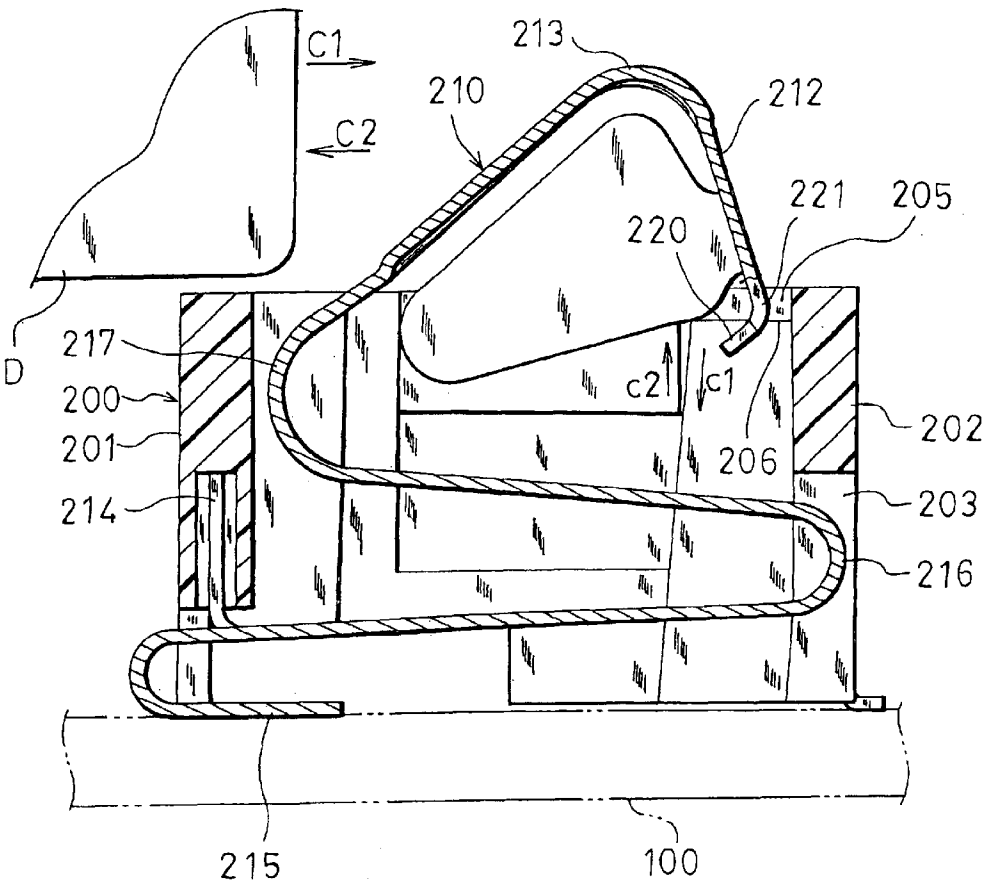
Fig. 9 PRIOR ART
FIG. 9 is a section view of a conventional battery connector.
Figure 10:
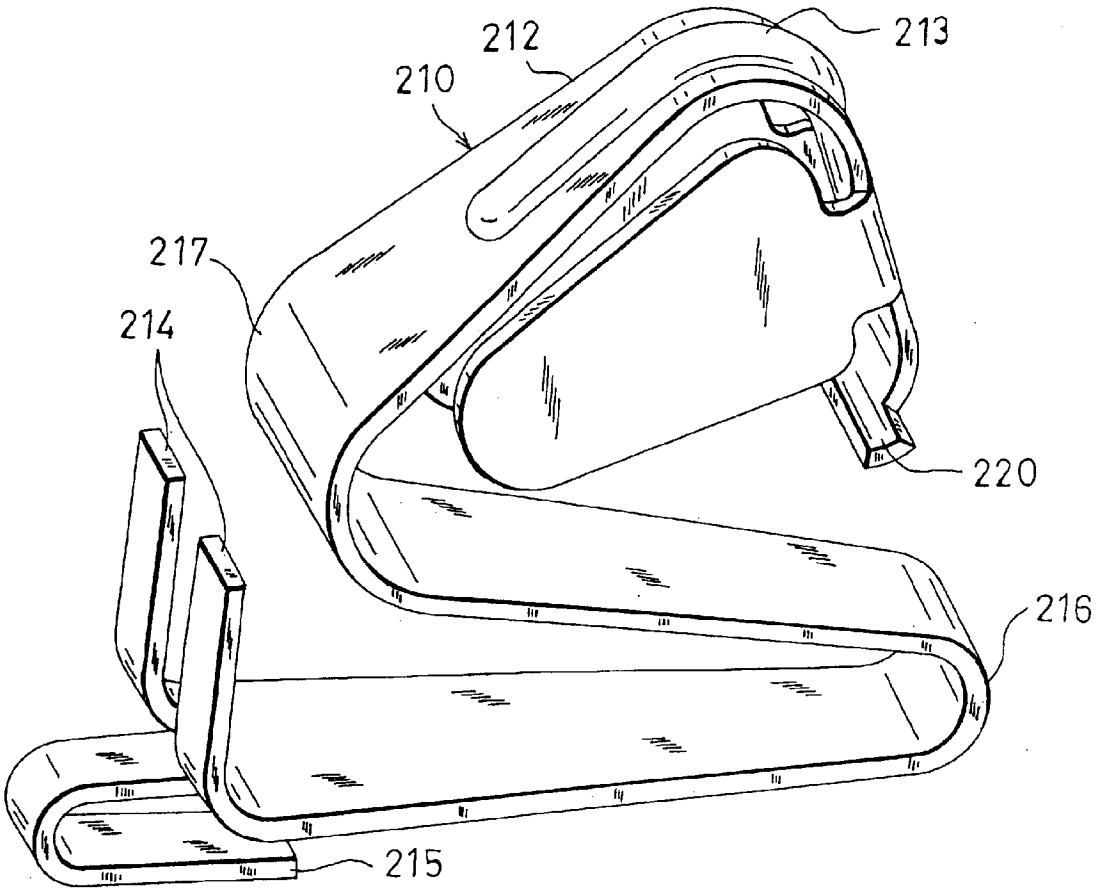
Fig. 10 PRIOR ART
FIG. 10 is a perspective view of a contact member which is used in the conventional battery connector.
Figure 11:
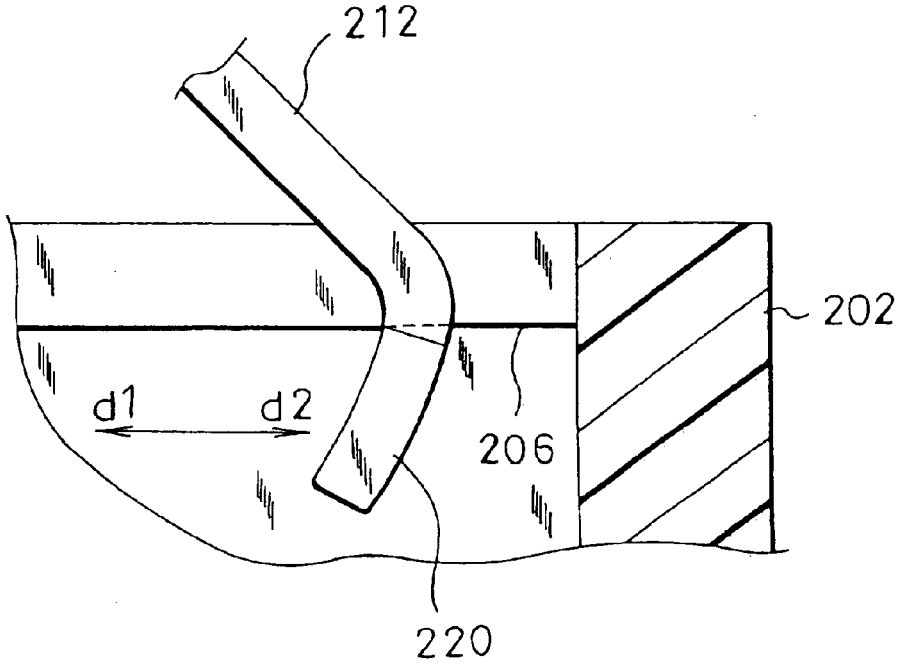
Fig. 11 PRIOR ART
FIG. 11 is a view showing problems of the conventional example.

FIG. 7A is a perspective view showing a modification of the engagement piece portion 66, FIG. 7B is an enlarged section view taken along line VIIB—VIIB of FIG. 7A, and FIG. 8 is a view illustrating the function which is exerted by the engagement piece portion 66 of FIGS. 7A and 7B.

In the engagement piece portion 66 of FIGS. 7A and 7B, a spherical swollen portion 75 is formed in each of right and left sides of the rectangular planar portion 71. In the engagement piece portion 66, as shown in FIG. 8, the swollen portions 75 butt against the engagement face 21 to hold the planar portion 71 to a position separated from the engagement face 21. Even when, in an abnormal state, an accidental situation occurs where the engagement piece portion 66 slides in the direction indicated by the arrow a1' or a2' while maintaining the elastic contact with the engagement face 21, therefore, only the swollen portions 75 of the engagement piece portion 66 overlap and rub with the engagement face 21, so that the engagement face 21 is not shaved and the engagement piece portion 66 is not caught by the engagement face 21 to be deformed. The above similarly occurs also in a situation where, in a battery attaching operation in a normal state, the engagement piece portion 66 rubs with the engagement face 21. When the swollen portions 75 having no angular edge in the engagement piece portion 66 rub with the engagement face 21 as in this example, particularly, the frictional resistance between the swollen portions 75 and the engagement face 21 is suppressed to a low degree and the sliding property is improved. Therefore, an excessive force is hardly applied to the mountain-like projection 56 and hence to the contact member 5, thereby producing an advantage that the durability of the contact member is improved.

The shape of the swollen portions 75 is not limited to a spherical shape, and may be, for example, an arcuate shape which extends over the whole lateral length of the engagement piece portion 66.

What is claimed is:

1. A battery connector having:

a meandering contact member in which a plurality of plate piece portions are continuously integrated with one another through one or more arcuate flexible portions;

a mountain-like projection which is formed in one of said plate piece portions that is on one end side of said contact member, and in which a top is formed as a contact that is to be in elastic contact with a battery terminal;

a housing which houses said contact member;

an opening which is formed in said housing, and through which said mountain-like projection is projected;

an arcuate portion which is formed in said mountain-like projection to be bent toward an inner side of said mountain-like projection, and an engagement piece portion which is laterally projected from an end portion of said arcuate portion; and an engagement face which is formed by a rear face of a peripheral portion of said opening, and with which said engagement piece portion is in elastic contact and engaged under a preload, whereby a degree of projection of said mountain-like projection from said opening is restricted, wherein said battery connector further has a wall face of said housing that is to confront a board face of a circuit board on which said housing is to be mounted, and that opposes said arcuate portion of said mountain-like projection, and said engagement piece portion is displaced in a direction along which said board face of said circuit board and said wall face of said housing confront each other, to be in sliding contact with said engagement face, and has a shape which is free from an angular edge that, when said engagement piece portion is in sliding contact with said engagement face, shaves said engagement face.

2. A battery connector having: a meandering contact member in which a plurality of plate piece portions are continuously integrated with one another through one or more arcuate flexible portions;

a mountain-like projection which is formed in one of said plate piece portions that is on one end side of said contact member, and in which a top is formed as a contact that is to be in elastic contact with a battery terminal;

a housing which houses said contact member;

an opening which is formed in said housing, and through which said mountain-like projection is projected;

an arcuate portion which is formed in said mountain-like projection to be bent toward an inner side of said mountain-like projection, and an engagement piece portion which is laterally projected from an end portion of said arcuate portion; and an engagement face which is formed by a rear face of a peripheral portion of said opening, and with which said engagement piece portion is in elastic contact and engaged under a preload, whereby a degree of projection of said mountain-like projection from said opening is restricted, wherein:

said battery connector further has a wall face of said housing that is to confront a board face of a circuit board on which said housing is to be mounted, and that opposes said arcuate portion of said mountain-like projection, said engagement piece portion is displaced in a direction along which said board face of said circuit board and said wall face of said housing confront each other, to be in sliding contact with said engagement face, and has a shape which is free from an angular edge that, when said engagement piece portion is in sliding contact with said engagement face, shaves said engagement face, and said engagement piece portion integrally has: a planar portion in which an edge of each of lateral sides is elongated in the confronting direction, and which is slidably contactable with said engagement face; and a projection piece which, in each of sides of a vertical width direction of said planar portion, is elongated through an arcuate bent portion in a direction away from said engagement face.

3. A battery connector according to claim 2, wherein, in said housing, a portion that is opposed to a wall face of said housing to which said arcuate portion of said mountain-like projection is opposed is formed as an aperture, and said aperture is closed by said circuit board on which said housing is to be placed.

4. A battery connector according to claim 4, wherein said housing has: a surrounding wall having said opening; a supporting wall which is opposed to said surrounding wall; and a covering wall which extends between upper ends of said surrounding wall and said supporting wall, one of said plate pieces that is on another end side of said contact member is placed to overlap with said supporting wall, and one of flexural portions which is continuously integrated with said plate piece portion of the other end side is fitted into a recess formed in said covering wall.

5. A battery connector according to claim 4, wherein a lower half of said surrounding wall is forward projected, and a reinforcing wall which closes a lower portion of said opening is formed integrally on said projected portion.

6. A battery connector according to claim 5, wherein said reinforcing wall is disposed in each of right and left or two places of said projected portion, and a reinforcement terminal which reinforces said housing is placed in a recess between said reinforcing walls.

7. A battery connector having:

a meandering contact member in which a plurality of plate piece portions are continuously integrated with one another through one or more arcuate flexible portions;

a mountain-like projection which is formed in one of said plate piece portions that is on one end side of said contact member, and in which a top is formed as a contact that is to be in elastic contact with a battery terminal;

a housing which houses said contact member;

an opening which is formed in said housing, and through which said mountain-like projection is projected;

an arcuate portion which is formed in said mountain-like projection to be bent toward an inner side of said mountain-like projection, and an engagement piece portion which is laterally projected from an end portion of said arcuate portion; and an engagement face which is formed by a rear face of a peripheral portion of said opening, and with which said engagement piece portion is in elastic contact and engaged under a preload, whereby a degree of projection of said mountain-like projection from said opening is restricted, wherein:

said battery connector further has a wall face of said housing that is to confront a board face of a circuit board on which said housing is to be mounted, and that opposes said arcuate portion of said mountain-like projection, said engagement piece portion is displaced in a direction along which said board face of said circuit board and said wall face of said housing confront each other, to be in sliding contact with said engagement face, and has a shape which is free from an angular edge that, when said engagement piece portion is in sliding contact with said engagement face, shaves said engagement face, and said engagement piece portion integrally has: a planar portion; and a swollen portion which is formed on said planar portion, and which comprises an arcuate face that is to butt against said engagement face to hold said planar portion to a position separated from said engagement face.

8. A battery connector according to claim 7, wherein, in said housing, a portion that is opposed to said wall face of said housing to which said arcuate portion of said mountain-like projection is opposed is formed as an aperture, and said aperture is closed by said circuit board on which said housing is to be placed.

9. A battery connector according to claim 8, wherein said housing has: a surrounding wall having said opening; a supporting wall which opposed to said surrounding wall; and a covering wall which extends between upper ends of said surrounding wall and said supporting wall, one of said plate pieces that is on another end side of said contact member is placed to overlap with said supporting wall, and one of flexural portions which is continuously integrated with said plate piece portion of the other end side is fitted into a recess formed in said covering wall.

10. A battery connector according to claim 9, wherein a lower half of said surrounding wall is formed projected, and a reinforcing wall which closes a lower portion of said opening is formed integrally on said projected portion.

11. A battery connector according to claim 10, wherein said reinforcing wall is disposed in each of right and left or two places of said projected portion, and a reinforcement terminal which reinforces said housing is placed in a recess between said reinforcing walls.

* * * * *

UNITED STATES PATENT AND TRADEMARK OFFICE

CERTIFICATE OF CORRECTION

PATENT NO. : 6,908,341 B2
APPLICATION NO. : 10/720227
DATED : June 21, 2005
INVENTOR(S) : Shirae et al.

It is certified that error appears in the above-identified patent and that said Letters Patent is hereby corrected as shown below:

Column 9, line 42, please delete “claim 4” and insert therein -- claim 3 --

Signed and Sealed this

First Day of May, 2007

JON W. DUDAS
*Director of the United States Patent and Trademark Office*